US005193683A

United States Patent [19]

Key

[11] Patent Number: 5,193,683

[45] Date of Patent: Mar. 16, 1993

[54] STACKABLE CONTAINER

[76] Inventor: Luther L. Key, Rte. 1, Box 131, Roaring River, N.C. 28669

[21] Appl. No.: 784,647

[22] Filed: Oct. 28, 1991

Related U.S. Application Data

[63] Continuation of Ser. No. 686,813, Jan. 17, 1991, abandoned.

[51] Int. Cl.[5] ..... B65D 21/00

[52] U.S. Cl. ..... 206/503; 446/111

[58] Field of Search ..... 446/100, 111, 117, 102; 206/503, 513

[56] References Cited

U.S. PATENT DOCUMENTS

| | | | |
|---|---|---|---|
| 885,159 | 4/1908 | Keys . | |
| 2,007,644 | 7/1935 | Frank . | |
| 2,665,049 | 1/1954 | George . | |
| 3,635,361 | 1/1972 | Hayes . | |
| 3,648,849 | 3/1972 | Harris et al. | 206/503 |
| 3,749,273 | 7/1973 | Wreghitt et al. . | |
| 3,889,867 | 6/1975 | Berg | 206/503 |
| 4,179,061 | 12/1979 | Gilbert . | |
| 4,300,685 | 11/1981 | Stern | 206/503 |
| 4,693,345 | 9/1987 | Mittelmann | 206/503 |
| 4,757,910 | 7/1988 | Box | 206/503 |

*Primary Examiner*—Joseph Man-Fu Moy

*Attorney, Agent, or Firm*—Bell, Seltzer, Park & Gibson

[57] ABSTRACT

A stackable rectangular cylinder for use as a container for food service and as a children's toy for erecting structures. The container includes a top wall and an opposed bottom wall, sidewalls and end walls which define an enclosure, and a partition which divides the space therein. A plurality of tabs defined by opposing sides of the end walls and partition extend through and beyond paired collinear slits in the sidewalls. A first pair of tabs on each opposing edge of the end walls and partition is adapted to be engaged by elastic bands which bridge unslitted portions of the associated sidewall to releasably maintain the divided enclosure. When several of the containers are stacked, a second pair of tabs on each opposing edge of the end walls and partition may be engaged by elastic bands which extend between each such tab and a corresponding tab on an adjacent container to interconnect the containers.

20 Claims, 2 Drawing Sheets

STACKABLE CONTAINER

This application is a continuation of application Ser. No. 07/686,813, filed Apr. 17, 1991, now abandoned.

FIELD OF THE INVENTION

The present invention relates to rectangular cylinders such as containers which may be stacked and interconnected to construct a wall or similar structure. In particular, the invention relates to a container especially adapted for food service use which may also be used as a children's toy.

BACKGROUND OF THE INVENTION

Many businesses derive large portions of their revenues from sales of products or goods using advertising directed toward children. Vendors of products which require external packaging often wish to package their products in containers which themselves hold some appeal for children. Many schemes have been used for this purpose, including, for example, application of some sort of fanciful decoration to the exterior of a box or other container in which the product is presented to the consumer.

This marketing trend has been particularly apparent in the fast food restaurant industry. Due to the high level of competition in the fast food industry and the relative standardization of many of the food products for which a consumer demand exists, competing restaurant chains frequently seek to attract customers through promotional advertising. One tactic that is sometimes used by fast food chains in conjunction with such promotional advertising is to provide a children's game or toy along with the meal. By so doing, restauranteurs hope that advertising directed at children which focuses on the game or toy rather than the food will result in increased sales.

For such child directed promotions to be successful, it is imperative that the toy included with the meal be of nominal additional cost to avoid unduly increasing the overall cost to the consumer of the food product and to avoid eroding the restauranteurs' profits. As the food must be presented to customers in some sort of packaging to insure cleanliness and ease of handling, the ideal approach to such promotional sales is to incorporate the toy into the food packaging itself, thereby minimizing the added expense of the toy.

The toy provided with the packaging must be safe, easy to use and fun, and should be ready to use when sold so that little or no assembly is required by the child or his parent. Likewise, any supplemental items which may be needed to play with the toy in its intended fashion should be readily available items commonly found in most households so that children may easily play with the toy without the need for parents to purchase additional items. Preferably, the toy should be of a type such that children will want to use more than one of the toys when playing. This ensures that children who have acquired one of the toys will have a continuing demand for additional toys, thereby generating repeat sales for the restauranteur or other vendor.

Blocks made of wood, plastic or the like are toys which are commonly used by children. Such toy blocks usually have regular shapes, such as a rectangular cylinder. The blocks are therefore stackable and are often used by children to create miniature structures such as walls and imaginary fortresses. However, the blocks are not generally provided with means for interconnecting adjacent stacked blocks. Hence, although the blocks may be stacked to erect walls or other structures, the resultant assemblage is relatively fragile and may be easily knocked over.

Relatively rigid structures may be created by stacking a plurality of rectangular cylinders on top of each other and thereafter interconnecting adjacent stacked cylinders. Bricks of the type used in the building industry are a typical example of rectangular cylinders which may be stacked to form a rigid structure. In this example, mortar or cement is used to interconnect adjacent bricks such that a rigid wall may be formed. However, the stacked interconnected bricks are not easily disassembled.

Stackable containers having releasable means for interconnecting adjacent stacked containers are shown in U.S. Pat. No. 3,749,273 to Wreghitt et al., and in U.S. Pat. No. 3,635,361 to Hays. The containers shown in these patents are not, however, suitable for inexpensive manufacture and use in retail food service handling, and they require use of devices for interconnecting adjacent containers which are not readily available in most homes.

In light of the aforementioned deficiencies, it is an object of the present invention to provide a new rectangular cylinder which may be readily stacked and interconnected by commonly available devices.

Another object of the present invention is to provide a container for use in food service which may also be used as a child's toy.

Yet another object of the present invention is to provide an inexpensive stackable cylinder which may be constructed of disposable materials.

A further object of the present invention is to provide a stackable rectangular cylinder which may be interconnected with adjacent cylinders to form a rigid wall or similar structure but which may also be disassembled with ease.

Another object of the present invention is to provide a stackable rectangular cylinder which is a safe, inexpensive, and fun toy for use by children.

SUMMARY OF THE INVENTION

The above and other objects and advantages of the present invention are achieved in the embodiment described herein by the provision of a rectangular cylinder having a top wall and an opposed bottom wall, two opposed sidewalls extending between the top and bottom walls, two opposed end walls, and a partition between the end walls and generally parallel thereto. The top wall, bottom wall and sidewalls are formed of a folded single section of sheet material, and the end walls and partition are formed of separate sections of sheet material. The end walls and partition have first and second pairs of tabs defined on opposite edges thereof which extend into and through respective ones of a plurality of paired collinear slits aligned generally adjacent and parallel each lateral edge of the sidewalls and along a medial portion of each sidewall. Cooperation of the tabs and slits retains the end walls adjacent the lateral edges of the sidewalls to define a fully enclosed container, and retains the partition in the medial portion of the enclosure to divide the enclosure. The first pair of tabs defined on each opposed edge of the end walls and partition have outer edges which are inclined away from each other so as to be adapted to be effectively engaged by releasable securing means such as an elastic band or the like which bridges an unslitted portion of the associated sidewall between the paired collinear slits to releasably maintain the enclosure. The second pair of tabs are positioned outside the first pair of tabs on each opposed edge of the end walls and partition and have inner edges which are inclined toward each other so as to be effectively engaged by releasable securing means such as an elastic band which extends between such tab and a corresponding tab on an adjacent cylinder to interconnect the adjacent cylinders. When multiple cylinders are stacked in staggered arrangement, the releasable securing means may extend from a tab of an end wall of one cylinder to an outer tab of a partition of an adjacent cylinder. Thus, a rigid wall or structure may be readily constructed.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate a preferred and exemplary embodiment, and wherein.

DESCRIPTION OF THE PREFERRED EMBODIMENT

Figure 1:
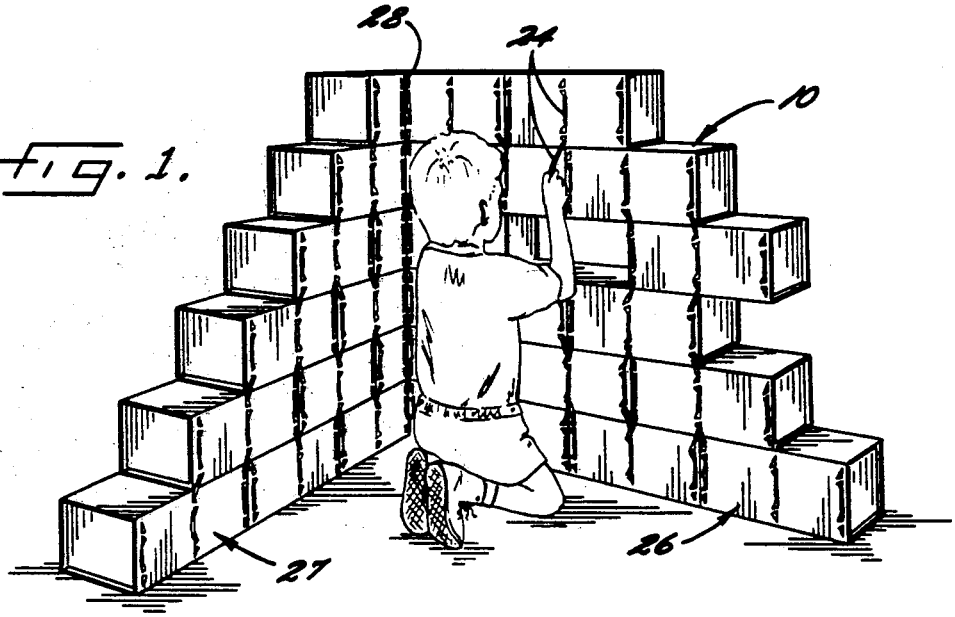
FIG. 1 is a perspective environmental view of one preferred embodiment of a stackable container made in accordance with the present invention.
Figure 2:
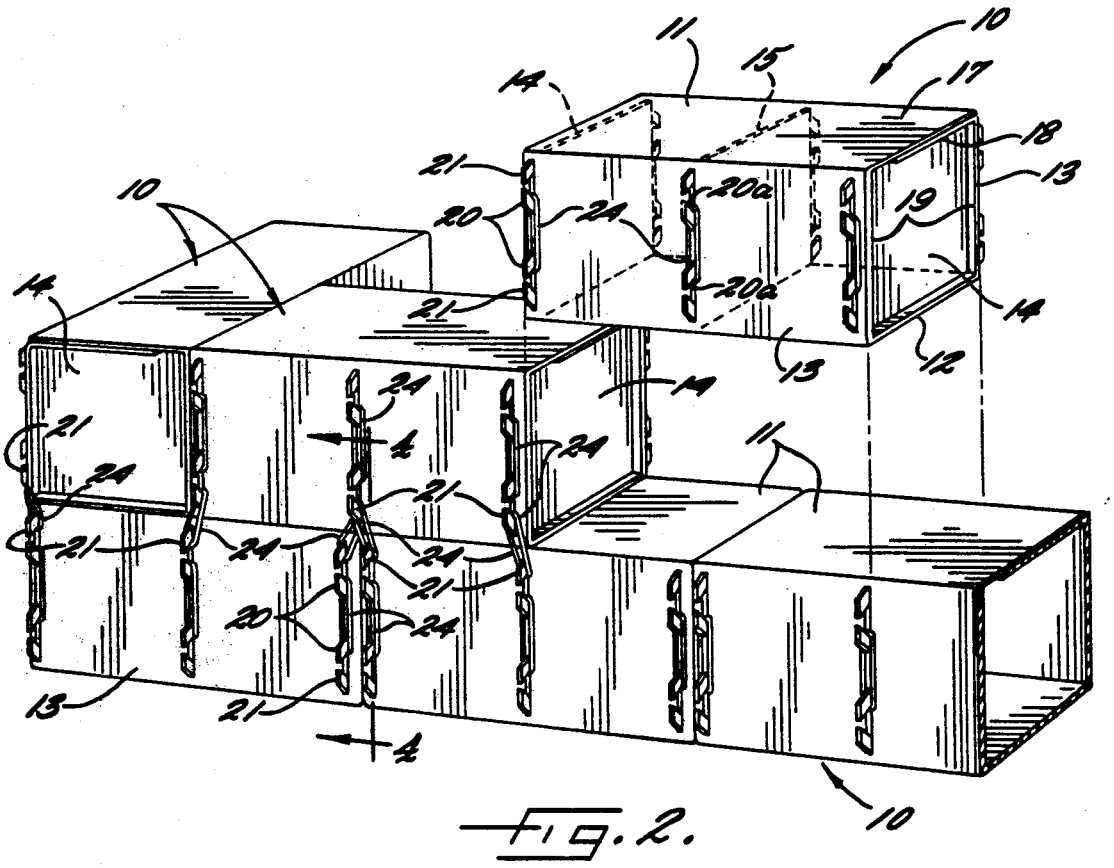
FIG. 2 is a perspective view showing multiple containers made in accordance with the present invention stacked atop each other in staggered arrangement and illustrating interconnection of adjacent stacked containers.
Figure 3:
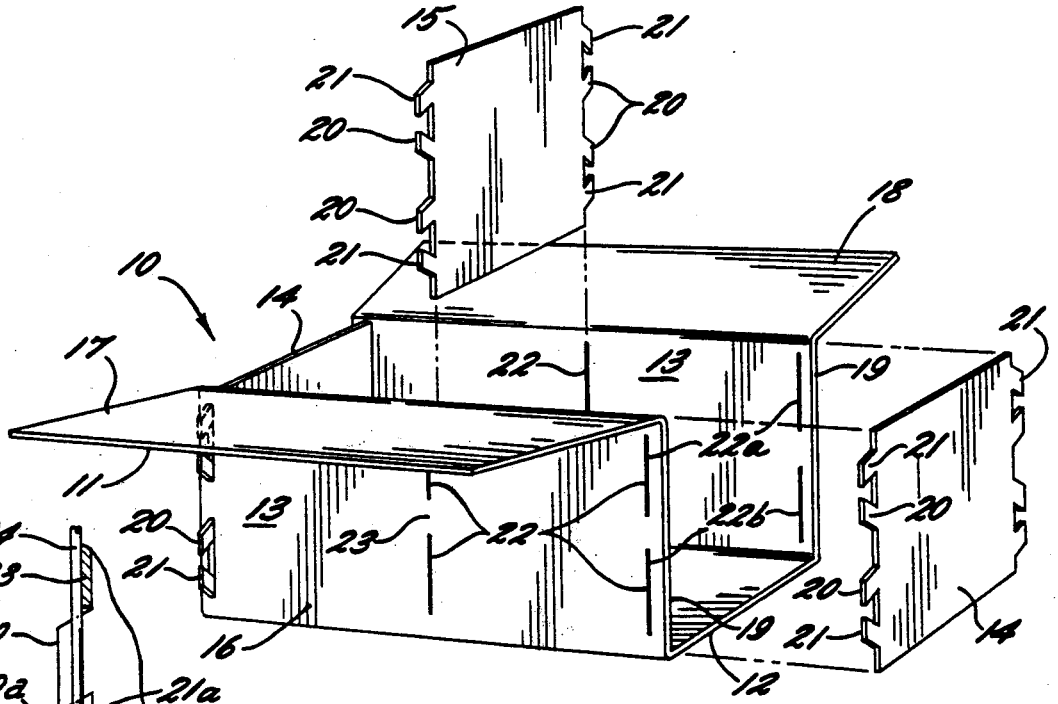
FIG. 3 is a partially exploded view of a preferred embodiment of the present invention.

Referring now to the drawings, FIG. 1 illustrates multiple stackable rectangular cylinders, one of which is designated generally at 10, which are made in accordance with the present invention. The rectangular cylinders 10 in FIG. 1 have been assembled into a rigid structure. FIGS. 2 and 3 more clearly illustrate the stackable rectangular cylinder 10, which has six exterior faces formed by a top wall 10 and an opposinq bottom wall i2, two opposed sidewalls 13 and two opposed end walls 14.

In a preferred embodiment, the rectangular cylinder 10 is a hollow structure defining an enclosure which may be used as a container for food service or the like. Also in a preferred embodiment, a partition 15 extends through the interior space defined by the rectangular cylinder lo. The partition 15 is oriented generally parallel to the end walls 14, thereby dividing the space within the rectangular cylinder 10 into two separate compartments. The sidewalls 13 have lateral edges 19 which are generally perpendicular to the top wall 11 and bottom wall 12.

Also in a preferred embodiment, the rectangular cylinder 10 is constructed of folded sheet material such as cardboard, paper, plastic, corrugated board or metal. As illustrated in FIG. 3, the top wall 11, bottom wall 12, and sidewalls 13 are formed of a folded first section 16 of sheet material that has been cut to a size which defines the desired dimensions of the top wall 11, bottom wall 12 and the sidewalls 13. Portions of the first section of sheet material 16 are creased and folded as appropriate to form an openended rectangular cylinder. The end walls 14 and partition 15 are formed of separate sections of sheet material which are cut to desired sizes. The end walls 14 and partition 15 may be identical in size and shape.

In the embodiment shown in FIG. 3, the top wall 11 of the rectangular cylinder 10 is formed of first and second flaps 17 and 18 which may be secured against one another. Thus, the flaps 17 and 18 define an openable cover through which access may be had to the interior regions of the rectangular cylinder 10. Thus, food products or other items may readily be placed in or removed from the rectangular cylinder 10.

The end walls 14 and partition 15 have a plurality of tabs defined on opposite edges thereof. In a preferred embodiment, a first pair of tabs 20 are adjacent each other on each opposite edge, and a second pair of tabs 21 are located outside the first pair of tabs 20. Also, paired collinear slits 22 are aligned generally adjacent and parallel to each lateral edge 19 of the sidewalls 13 for receiving the first pair of tabs 20 and second pair of tabs 21 extending from the end walls 14. Paired collinear slits 22 may also be aligned parallel to the lateral edges 19 along a medial portion of each sidewall 13. Respective ones of slits 22 extending along the medial portions of the sidewalls 13 receive the first pair of tabs 20 and second pair of tabs 21 defined on opposing edges of the partition 15.

Figure 4:
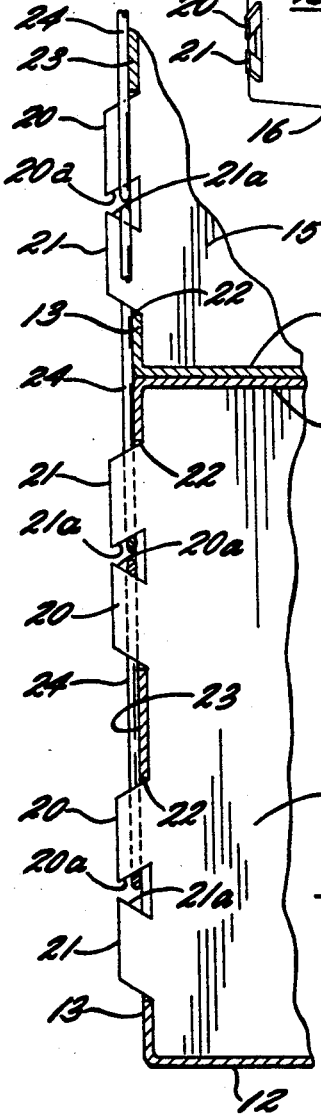
FIG. 4 is a partial cross sectional view taken along line 4–4 of FIG. 2 which illustrates the tabs of the present invention and their engagement by releasable securing means.

In a preferred embodiment, as illustrated in FIG. 4, an upper slit 22*a* of the paired collinear slits 22 is of an appropriate length to receive one tab 21 and the adjoining tab 20. A bottom slit 22*b* likewise may receive adjoining tabs 20 and 21.

Cooperation of respective ones of the slits 22 and tabs 20 and 21 permit the end walls 14 and partition 15 to be retained between the top wall 11, bottom wall 12 and sidewalls 13 so as to releasably maintain the assembly of the divided enclosure formed thereby. As shown in FIG. 4, to secure the tabs 20 and 21 within the slits 22 and thereby secure the end walls 14 and partition 15 against the sidewalls 13, the unslitted portion 23 between the collinear paired slits 22 in the associated sidewall 13 may be bridged by a releasable securing means 24 which is extended across the adjacent first pair of tabs 20.

Still referring to FIG. 4, the first pair of tabs 20 have outer edges 20*a* which are inclined away from each other so as to be effectively engaged by the releasable securing means 24. The releasable securing means 24 may be placed around the outer edge 20*a* of each tab 20 so that the releasable securing means 24 bridges the unslitted portion 23 of the associated sidewall 13 to releasably maintain the assembly of the enclosure. The releasable securing means 24 may be any readily available item. In a preferred embodiment, an elastic band made of rubber or the like is used as the releasable securing means 24.

As best illustrated in FIG. 2, multiple rectangular cylinders 10 may be stacked such that the bottom wall 12 of one rectangular cylinder 10 rests upon the top wall 11 of the rectangular cylinder or cylinders 10 immediately below it. The rectangular cylinders 10 may be stacked in a staggered arrangement, as shown in FIGS. 1 and 2, to construct a relatively strong structure. Of course, the rectangular cylinders 10 may be stacked in nonstaggered arrangement as well. Releasable securing means 24 such as an elastic band or the like may be extended between second paired tabs 21 on adjacent stacked cylinders 10 to interconnect the cylinders 10. As illustrated in FIG. 4, the second pair of tabs 21 are positioned outside the first pair of tabs 20 and extend through respective ones of the slits 22. The second pair of tabs 21 have inner edges 21*a* which are inclined away from each other so as to be adapted to be effectively engaged by releasable securing means 24 which extends between such tab and a corresponding tab 21 on an adjacent cylinder. The angular orientation of the inner edges 21*a*prevents the releasable securing means 24 from unintentionally disengaging the tabs 21.

Referring now to FIG. 2, the releasable securing means may extend between a tab 21 defined by the partition 15 of a first stackable cylinder 10 to a tab 21 defined by the end walls 14 of the rectangular cylinders 10 immediately adjacent thereto. Each of the second pair of tabs 21 are sufficiently large to permit engagement by multiple releasable securing means 24 so that three tabs 21 may be interconnected in locking relationship. As also shown in FIG. 2, a cylinder 10 may be positioned so that its sidewalls 13 are oriented at a 90 degree angle with the sidewalls 13 of the cylinder 10 immediately above or below it. In this instance, releasable securing means 24 may extend between a tab 21 defined by an end wall 14 of a lower rectangular cylinder 10 to a tab 21 defined by an end wall 14 of the upper rectangular cylinder 10. Thus, the cylinders 10 may be assembled to erect structures such as walls 26 and 27 having a corner 28.

The rectangular cylinder 10 described above may be used as a container for food service or the like which incorporates a toy for use by children. Alternatively, the rectangular cylinders 10 may also be sold solely as toys or as part of a building system.

In the drawings and specification, there has been disclosed a typical preferred embodiment of the invention. Although specific terms have been employed, they have been used in a generic and descriptive sense only and not for purposes of limitation, the scope of the invention being set forth in the following claims.

What is claimed is:

1. A container for food service or the like which may also be used as a children's toy for erecting structures such as walls or the like comprising a top wall and an opposing bottom wall;

two opposed side walls extending between said top and bottom walls, each said side wall having lateral edges perpendicular to said top and bottom walls;

paired collinear slits aligned adjacent each said lateral edge of each of said side walls and along a medial portion of each said side wall, said slits being parallel to said lateral edges; and two opposed end walls and a partition, each said end wall and partition having parallel opposite edges and first and second pairs of tabs positioned on each of said opposite edges, said first and second pairs of tabs on each of said opposite edges of said end walls extending through and beyond respective ones of said paired collinear slits adjacent said lateral edges to retain said end walls between said top and bottom walls and generally perpendicular to said opposed side walls such that said top wall, bottom wall, side walls and end walls define an enclosure, and said first and second pairs of tabs on each of said opposite edges of said partition extending through and beyond respective ones of said slits in said medial portions to suspend said partition generally parallel to said end walls to divide the space within said enclosure, each of said first pair of tabs being positioned adjacent each other and being adapted to be engaged by an elastic band to secure said tabs within said slits in said side walls, and each of said second pair of tabs being positioned outside the associated first pair of tabs and being adapted to be engaged by additional elastic bands for interconnecting adjacent stacked containers.

2. A container as defined in claim 1 wherein said top wall, bottom wall and side walls are formed of a folded first section of sheet material and wherein said end walls and partition are formed of separate sections of sheet material.

3. A container as defined in claim 2 wherein each of said first pair of tabs has outer edges which are inclined away from each other so as to be adapted to be effectively engaged by an elastic band which bridges the unslitted portion of the associated side wall.

4. A container as defined in claim 3 wherein each of said second pair of tabs has inner edges which are inclined toward each other so as to be adapted to be effectively engaged by an elastic band which extends between such tab and a corresponding tab on an adjacent stacked container to interconnect an adjacent container of like construction.

5. A container as defined in claim 2 wherein said sheet material is selected from the group comprising cardboard, paper, plastic and metal.

6. A wall or similar rigid structure comprising a plurality of rectangular cylinders stacked in staggered arrangement, each said rectangular cylinder formed of a top wall and an opposing bottom wall, two sidewalls having lateral edges perpendicular to said top and bottom walls and having paired collinear slits aligned adjacent and parallel to each said lateral edge and in a medial portion of each said sidewall, two opposed end walls, and a partition intermediate to and generally parallel said end walls, said end walls and partition having a plurality of tabs defined on opposite edges thereof which extend through and beyond respective ones of said paired collinear slits such that said top wall, bottom wall, sidewalls, end walls and partition define a partitioned enclosure; and a plurality of elastic bands which engage adjacent said tabs on each cylinder to releasably maintain the assembly of said partitioned enclosures and which engage said tabs on adjacent stacked cylinders to interconnect said cylinders in staggered arrangement.

7. A stackable rectangular cylinder comprising two opposed side walls, with each said sidewall having parallel top and bottom edges, and a pair of parallel end edges extending laterally between said top and bottom edges;

a pair of collinear slits aligned adjacent and parallel to each of said end edges of each of said side walls;

two opposed end walls positioned perpendicularly between said side walls and having at least one pair of tabs extending from each of the opposite edges of each end wall, said tabs extending through and beyond respective ones of said slits to retain said end walls between said side walls and such that said side walls and end walls define and enclosure; and releasable securing means for engaging said one pair of tabs of each opposite edge of each end wall and bridging unslitted portions of said side walls between said pairs of collinear slits to secure said tabs within said slits, and so as to releasably maintain the assembly of said enclosure.

8. A stackable cylinder as defined in claim 7 wherein first and second pairs of said tabs extend from each of said opposite edges of each of said end walls, said first pair of tabs being positioned adjacent each other to be engaged by said releasable securing means to secure said tabs within said slits in said side walls, and said second pair of tabs being positioned outside said first pair of tabs and being adapted to be engaged by additional releasable securing means for interconnecting adjacent stacked cylinders.

9. A stackable cylinder as defined in claim 8 wherein each of said first pair of tabs have outer edges which are inclined away from each other so as to be adapted to be effectively engaged by said releasable securing means which bridges the unslitted portion of the associated side wall.

10. A stackable cylinder as defined in claim 9 wherein said second pair of tabs have inner edges which are inclined toward each other so that each of said second pair of tabs is adapted to be effectively engaged by an additional said releasable securing means which extends between such tab and a corresponding tab on an adjacent stacked cylinder to interconnect adjacent cylinders.

11. A stackable cylinder as defined in claim 7 further comprising a pair of collinear slits aligned along a medial portion of each of said sidewalls and parallel to said end edges therefor, and a partition having at least one pair of tabs extending from each of the opposite edges thereof and extending through and beyond respective ones of said collinear slits in said medial portions of said side walls to support said partition generally parallel to said end walls and thereby divide the space within said enclosure, and releasable securing means for engaging said one pair of tabs of each opposite edge of said partition and bridging unslitted portions of the associated sidewall to releasably maintain the assembly of said partition and said side walls.

12. A stackable cylinder as defined in claim 11 further comprising a top wall and an opposing bottom wall, and wherein said top wall, bottom wall and sidewalls are formed of a folded first section of sheet material and wherein said end walls and partition are formed of separate sections of sheet material.

13. A stackable cylinder as defined in claim 11 wherein first and second pairs of each tabs extend from each of said opposing edges of each of said end walls and partition, said first pair of tabs being positioned adjacent each other to be engaged by said releasable securing means to secure said tabs within said slits in said sidewalls, and said second pair of tabs being positioned outside said first pair of tabs and being adapted to be engaged by additional releasable securing means for interconnecting adjacent stacked cylinders.

14. A stackable cylinder as defined in claim 7 wherein said releasable securing means are elastic bands.

15. A stackable cylinder as defined in claim 7 further comprising a top wall and an opposing bottom wall, with said top wall and said bottom wall each being joined to at least one of said sidewalls and so as to define a six sided enclosure.

16. A stackable rectangular cylinder comprising two opposed side walls, with each side wall having parallel top and bottom edges, and a pair of parallel end edges extending laterally between said top and bottom edges;

a pair of collinear slits aligned adjacent and parallel to each of said end edges of each of said side walls;

two opposed end walls positioned perpendicularly between said side walls and having at least one pair of tabs extending from each of the opposite edges of each end wall, said at least one pair of tabs extending through and beyond respective ones of said slits to retain said end walls between said side walls and such that said side walls and end walls define an enclosure, said at least one pair of tabs of each opposite edge of each end wall having outer edges which are inclined away from each other so as to be adapted to be effectively engaged by an elastic band which extends between said at least one pair of tabs and so as to bridge the unslitted portion of the associated side wall, and inner edges which are inclined toward each other so as to be adapted to be effectively engaged by an elastic band which extends between one of said tabs and a corresponding tab on an adjacent stacked cylinder to interconnect adjacent cylinders.

17. A stackable cylinder as defined in claim 16 wherein said at least one pair of tabs comprises a first pair of tabs extending through and beyond respective ones of said slits, and a second pair of tabs extending through and beyond respective ones of said slits and positioned outside of said first pair of tabs, and wherein said outer edges which are inclined away from each other are positioned on respective ones of said first pair of tabs, and said inner edges which are inclined toward each other are positioned on respective ones of said second pair of tabs.

18. A wall or similar rigid structure comprising a plurality of rectangular cylinders stacked in a staggered arrangement, each said rectangular cylinder including two side walls having lateral end edges and at least one slit aligned adjacent and parallel to each lateral end edge thereof, and two opposed end walls, said end walls each having tab means positioned on opposite edges thereof which extend through and beyond said at least one slit of the adjacent side wall such that said side walls and end walls define an enclosure; and a plurality of elastic bands extending between and engaging the tab means of vertically adjacent cylinders to releasably interconnect and maintain the assembly of said cylinders in the stacked arrangement.

19. The wall as defined in claim 18 wherein each of said two side walls has a pair of collinear slits adjacent and parallel to each lateral end edge thereof, and each of said tab means comprises at least one pair of tabs extending through and beyond respective ones of said slits.

20. The wall as defined in claim 19 wherein said at least one pair of tabs of each opposite edge of each end wall includes outer edges which are inclined away from each other so as to be adapted to be effectively engaged by an elastic band which extends between said at least one pair of tabs and so as to bridge the unslitted portion of the associated side wall, and inner edges which are inclined toward each other so as to be adapted to be effectively engaged by an elastic band which extends between one of said tabs and a corresponding tab on an adjacent stacked cylinder to interconnect adjacent cylinders.

* * * * *